US005319344A

United States Patent [19]

Mosesian et al.

[11] Patent Number: 5,319,344

[45] Date of Patent: Jun. 7, 1994

[54] EXTERNALLY MOUNTED BLOWN FUSE INDICATOR

[75] Inventors: Jerry L. Mosesian, Newburyport, Mass.; Howard J. Parker, York, Me.; Richard J. Perreault, Amesbury, Mass.; George F. Walker, Jr., Lee, N.H.

[73] Assignee: Gould Electronics Inc., Eastlake, Ohio

[21] Appl. No.: 7,076

[22] Filed: Jan. 21, 1993

[51] Int. Cl.[5] ..... H01H 85/30

[52] U.S. Cl. ..... 337/244; 337/267

[58] Field of Search ..... 337/244, 241, 265, 267

[56] References Cited

U.S. PATENT DOCUMENTS

| | | | |
|---|---|---|---|
| 2,202,719 | 5/1940 | Schmidt . | |
| 2,405,929 | 8/1946 | Wald . | |
| 2,740,863 | 4/1956 | Basci . | |
| 3,274,358 | 9/1966 | Hallerberg . | |
| 3,358,100 | 12/1967 | Schleicher . | |
| 3,457,535 | 7/1969 | Poehlman, Jr. . | |
| 3,465,275 | 9/1969 | Swain . | |
| 3,546,692 | 12/1970 | Salzer . | |
| 3,621,431 | 11/1971 | Hitchcock, Sr. | 337/244 |
| 3,621,433 | 11/1971 | Belcher . | |
| 3,663,915 | 5/1972 | Kozacka . | |
| 3,721,936 | 3/1973 | Belcher . | |
| 3,783,428 | 1/1974 | Swain et al. . | |
| 3,794,948 | 2/1974 | Linton et al. . | |
| 3,824,520 | 7/1974 | Knapp, Jr. . | |
| 3,832,665 | 8/1974 | Belcher . | |
| 3,863,191 | 1/1975 | Salzer . | |
| 3,866,196 | 2/1975 | Mann et al. . | |
| 3,868,618 | 2/1975 | Dola . | |
| 3,889,222 | 6/1975 | Takano et al. | 337/244 |
| 4,016,762 | 4/1977 | Payne . | |
| 4,023,133 | 5/1977 | Knapp, Jr. . | |
| 4,091,435 | 5/1978 | Ahuja . | |
| 4,204,182 | 5/1980 | Knapp, Jr. . | |
| 4,323,874 | 4/1982 | Link . | |
| 4,387,358 | 6/1983 | Knapp, Jr. . | |
| 4,427,963 | 1/1984 | Jarosz et al. . | |
| 4,646,053 | 2/1987 | Mosesian . | |
| 4,691,197 | 9/1987 | Damiano et al. . | |
| 4,906,963 | 3/1990 | Ackermann et al. | 337/244 |
| 4,962,977 | 10/1990 | Suuronen . | |
| 5,002,505 | 3/1991 | Jones et al. . | |
| 5,055,818 | 10/1991 | Bueschel . | |
| 5,113,169 | 5/1992 | Ruehl et al. . | |

*Primary Examiner*—Harold Broome
*Attorney, Agent, or Firm*—Fish & Richardson

[57] ABSTRACT

An externally mounted blown fuse indicator including a housing, a spring-biased plunger, a tungsten restraining wire, two terminals, and a cover, the plunger having a meltable region that is heated by the restraining wire and melts to release the plunger when the fuse blows, the spring engaging a midsection of the plunger, the housing carrying tabs at its ends for engagement with a switch to be activated by the plunger, the spring-biased plunger having greater than 3 ounces force at an extension of 0.11".

61 Claims, 2 Drawing Sheets

EXTERNALLY MOUNTED BLOWN FUSE INDICATOR

BACKGROUND OF THE INVENTION

The invention relates to externally mounted blown fuse indicators.

Externally mounted blown fuse indicators are generally connected in parallel with a fuse and include thin restraining wires that restrain spring-biased plungers. When a fuse blows, all current temporarily goes through the thin restraining wire, which quickly melts and releases the spring-biased plunger. An example of such an indicator is described in U.S. Pat. No. 4,906,963.

SUMMARY OF THE INVENTION

In one aspect, the invention features, in general, an externally mounted blown fuse indicator including a housing, a spring-biased plunger, and a restraining wire. The plunger has a meltable region adjacent to a restraining wire receiving surface. The restraining wire has a melting temperature sufficiently higher than the melting temperature of the meltable region and has a sufficiently high electrical resistance to generate enough heat to melt the meltable region and release the plunger when the fuse blows. This permits stronger restraining wires to be employed, permitting improved impact resistance. It can also permit activation at lower voltages, e.g., as would be present when the fuse fails owing to cyclical loading as opposed to overcurrent.

In another aspect, the invention features, in general, an externally mounted blown fuse indicator including a plunger having a shaft that has an extending end portion that extends from the housing when the plunger is moved and a restraining wire receiving surface that is located at the opposite end of the shaft from the extending end portion. A spring engages a midsection of the plunger that is located between the restraining wire receiving surface and the extending end portion. This facilitates securing the restraining wire at a back surface of the housing and the accommodation of a large spring to provide large spring force and long plunger travel.

In another aspect, the invention features, in general, an externally mounted blown fuse indicator including a housing that has a surface for mounting on a fuse, is elongated, has terminals at its two ends, and carries tabs for engagement with a switch to be activated by a spring-biased plunger. The tabs are at the ends of the housing, so that the switch is aligned with the longitudinal axis of the housing, facilitating mounting of the indicator/switch combination.

In another aspect, the invention features, in general, an externally mounted blown fuse indicator including a housing, a spring-biased plunger that extends from the front surface of the housing, a restraining wire that is mechanically anchored to the back surface of the housing and engages the plunger, and a cover that is attached to the back surface of the housing and covers the restraining wire. This provides a simple design and simple assembly procedure.

In another aspect, the invention features, in general, an externally mounted blown fuse indicator having a spring-biased plunger that has greater than 3 ounces force (preferably greater than 3.5 ounces, and most preferably greater than 5.0 ounces) at an extension of greater than 0.11" (preferably greater than 0.15" and most preferably greater than 0.2"). This permits activation of a large number of microswitches having increased force and throw requirements.

In another aspect, the invention features, in general, an externally mounted blown fuse indicator employing a tungsten restraining wire. The wire has high strength, and thus provides impact resistance to the indicator. The wire has low specific heat, thereby generating lower internal pressure to be dissipated in the indicator. The wire also has a high melting temperature, facilitating melt-through when used with a plunger with a meltable region.

In preferred embodiments, the housing is made of insulating material. The restraining wire receiving surface is located at a notch at the end of the plunger. The plunger has a head that is engaged by the spring. The housing has a cylindrical recess that is coaxial with and surrounds the bore in which the plunger is located, and the spring sits in the cylindrical recess. The restraining wire is embedded in two potting material masses in wells in a back surface of the housing on opposite sides of the bore. The indicator has L-shaped terminals with anchored ends that are press-fitted into the housing on the shorter legs of the L shape, and connector ends that extend from opposite ends of the housing on the longer legs of the L shape. The restraining wire, potting material masses, and portions of the terminals are covered by a cover attached to the back surface of the housing. The housing has two axial slots along the bore in which a tranverse tab on the plunger can slide; the first slot has a stop surface against which the tab is biased when released from the restraining wire, and the second slot opens to the front surface so that the tab can be introduced into the second slot and be moved through an open region at the back of the housing to the first slot during assembly of the indicator.

Other features and advantages of the invention will be apparent from the following description of a preferred embodiment thereof and from the claims.

DESCRIPTION OF THE PREFERRED EMBODIMENT

The drawings will be described first.

DRAWINGS

STRUCTURE

Figure 1:
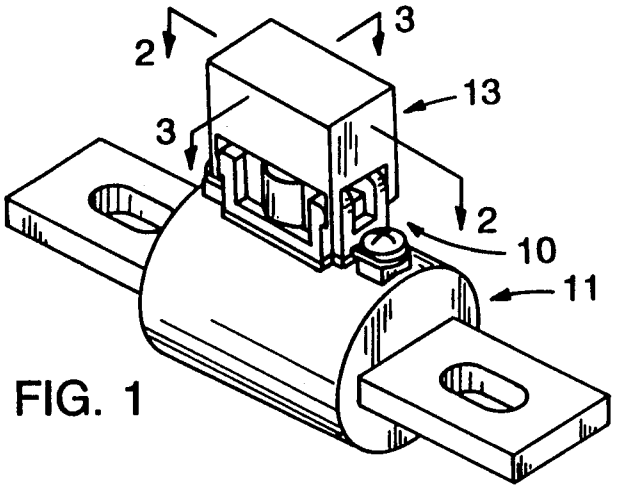
FIG. 1 is a perspective view of an externally mounted blown fuse indicator according to the invention attached to a fuse and a switch.
Figure 3:
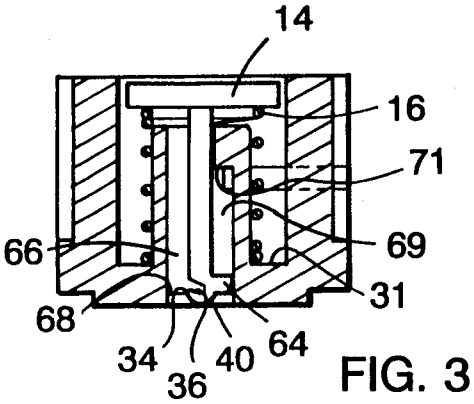
FIG. 3 is a vertical sectional view, taken at 3—3 of FIG. 1, of the FIG. 1 indicator.
Figure 2:
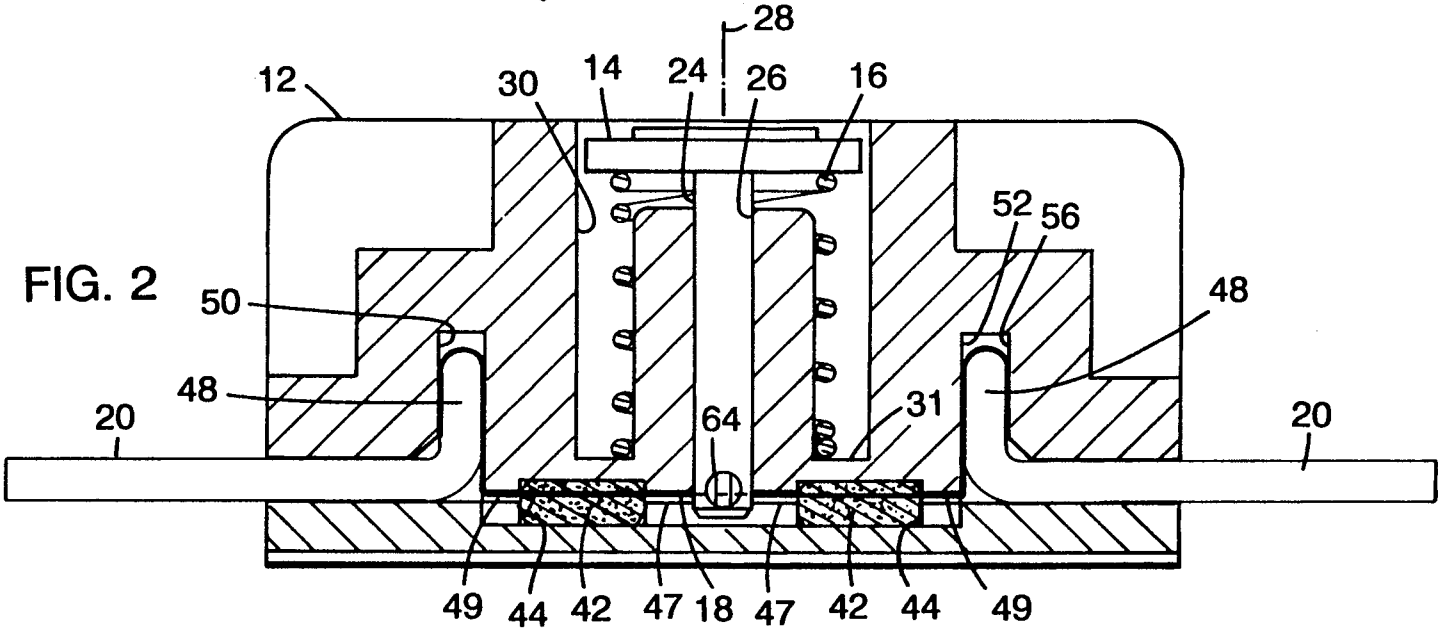
FIG. 2 is a vertical sectional view, taken at 2—2 of FIG. 1, of the FIG. 1 indicator.

Referring to FIGS. 1–5, blown fuse indicator 10 is shown mounted on fuse 11 and carrying switch 13 on its upper surface. Indicator 10 includes housing 12, plunger 14, spring 16, restraining wire 18, terminals 20 and cover 22. Shaft 24 of plunger 14 is received in bore 26 of housing 12 and slides along sliding axis 28. Spring 16, is 0.3" in diameter, made of stainless steel and provides the force and deflection characteristics described below. Spring 16 is received in cylindrical recess 30, which is coaxial with and surrounds bore 26. Spring 16 rests on surface 31 and pushes upward against the lower surface of head 32 of plunger 14. At the bottom of shaft 24, plunger 14 has notch 34 with restraining wire receiving surface 36 that is oriented transverse to sliding axis 28 and is engaged by restraining wire 18. Below notch 34, plunger 14 has 0.020" thick meltable region 40 that is adjacent to restraining wire receiving surface 36 and melts when wire 18 is heated during failure of a fuse. Restraining wire 18 is embedded in potting material masses 42 in wells 44 in back surface 46 of housing 12. Wells 44 are 0.170" in diameter and are 0.065" deep. Grooves 47 lead from bore 26 to wells 44, and similar grooves 49 lead from wells 44 to terminal recesses 50. Wire 18 is located in grooves 47 and 49 and enter wells 44 from both grooves at about one-half of the depth of wells 44.

Terminals 20 are L-shaped and have anchored ends 48 that are press-fitted into terminal recesses 50 in housing 12 and frictionally engage respective ends 52 of wire 18. The other legs of terminals 20 sit in channels 54 in back surface 46 and have connector ends 56 that extend from housing 12 on opposite sides along longitudinal housing axis 58, which is in a plane that is perpendicular to sliding axis 28.

Figure 4:
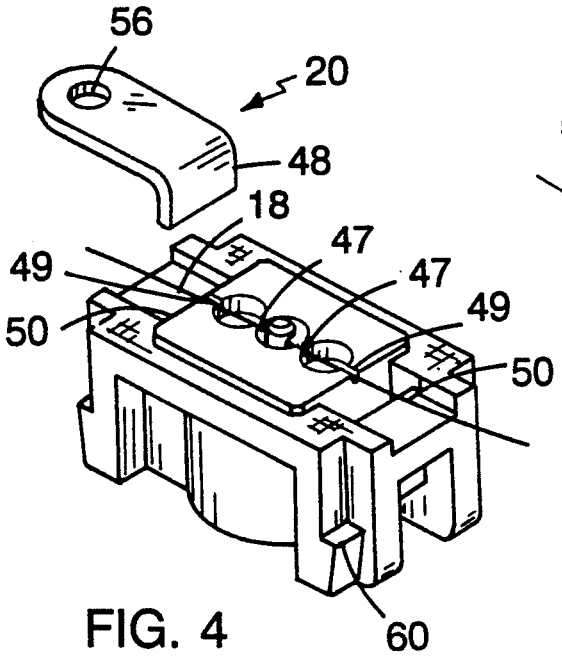
FIG. 4 is a blown-apart perspective view of components of the FIG. 1 indicator during assembly.
Figure 5:
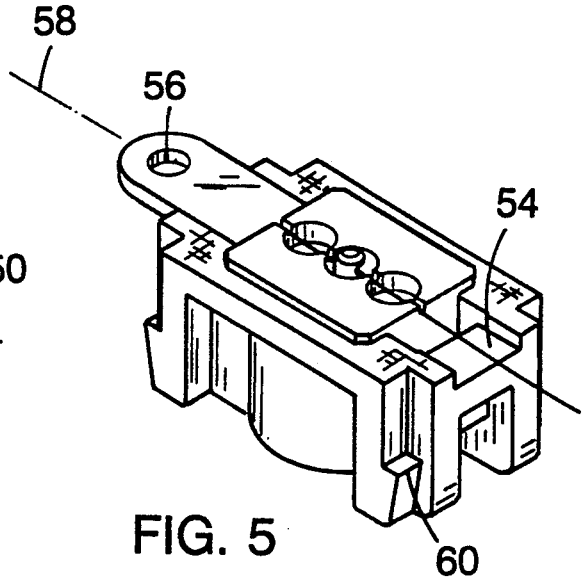
FIG. 5 is a perspective view of the FIG. 4 components at a later stage during assembly of the FIG. 1 indicator.

Referring to FIGS. 4 and 5, housing 12 has tabs 60 for engagement with fingers of switch 13. Tabs 60 are aligned with terminals 20 along longitudinal axis 58 so that switch 13 is aligned with housing 12, facilitating mounting of the combination of indicator 10, fuse 11, and switch 13.

Wire 18 is made of 99.95% pure tungsten and is between 0.0015" and 0.003" thick (preferably about 0.0025" thick). Wire 18 needs sufficient thickness to provide needed strength and quick temperature build-up but should not be so thick as to generate gasses causing an explosion under a short circuit condition.

Housing 12 and cover 22 are made of polycarbonate, in particular high temperature PPC series Lexan, available from General Electric under the trade designation PPC 4701 and having a heat deflection temperature of 163° C.

Plunger 14 is made of Nylon-6/6, e.g., available from Dupont under the Zytel 101 trade designation. It has a melting temperature that is much less than that of tungsten so that region 40 on plunger 14 melts when tungsten wire 18 heats up.

Potting material masses 44 are of ultraviolet cure adhesive available from Loctite Corporation under Tough Adhesive #352 trade designation. This material performs well as an arc quencher and has proper viscosity for ease of injection in the assembly process.

MANUFACTURE

In manufacture, plunger 14 and spring 16 are inserted into housing 12. Transverse tab 64 on plunger 14 slides in axial slot 66 along the sliding axis, and is rotated and held against surface 68 by spring force as a subassembly. Tab 64 is then rotated to be aligned with axial slot 69, and these three components are then held in a fixture with spring 16 in an overloaded condition. Wire 18 is then placed in notch 34, grooves 47, 49 and wells 44 and laid over terminal recesses 50, as shown in FIG. 4. Anchored ends 48 of terminals 20 are then inserted into terminal recess 50, as shown for the left-hand terminal 20 in FIGS. 4 and 5. The ends 52 of wire 18 are frictionally engaged between anchored ends 48 and the housing surfaces defining recesses 50, and wire 18 is pulled taught. Potting masses 42 are then injected into wells 44, embedding lengths of wire 18 between terminals 20 and plunger 14. Cover 22 is then adhered to back surface 46 by ultrasonic welding.

OPERATION

In use, indicator 10 is mounted with or without switch 13 on fuse 11 and is electrically connected in parallel with fuse 11. Under normal current conditions, virtually all of the current is conducted through fuse 10, owing to the fact that restraining wire 18 has a much greater resistance than the conducting components in fuse 11.

If fuse 11 fails during a short circuit or low overcurrent condition, all current is conducted through wire 18, which quickly heats up and melts meltable region 40, permitting spring 16 to bias plunger 14 outward until tab 64 rests against stop surface 71. Wire 18 fuses and creates an open circuit shortly thereafter. When wire 18 fuses, the low specific heat of the tungsten material employed generates low internal pressure that can be easily dissipated by potting masses 42 in indicator 10; this permits indicator 10 to be employed with fuses having high voltage ratings without problems of undue pressure and without the need for unduly large potting masses to extinguish arcs.

Figure 6:
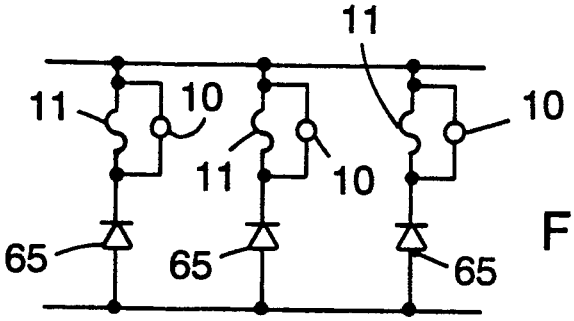
FIG. 6 is a schematic showing connection of pairs of the FIG. 1 fuse and blown fuse indicator in a particular circuit application.

The high melting temperature of tungsten facilitates melt-through of meltable region 40 at relatively low voltages that might be present if fuse 11 fails for another reason, e.g., stresses from cyclical loading. If the voltage drop in wire 18 resulting from the increased current through indicator 10 is greater than or equal to 0.5 volt, wire 18 will still heat sufficiently to melt region 40 and release plunger 14. E.g., FIG. 6 shows an application in which fuse 11 and indicator 10 are connected in series with diode 65, and a plurality of such fuse/diode combinations are connected in parallel. Cyclical loading might cause a fuse 11 to fail, with a voltage drop of about 0.5 volt appearing at the associated indicator 10. This voltage drop causes tungsten wire 18 to melt meltable region 40 and release plunger 14. This voltage drop is significantly lower than voltage drops of around 3.5 volts needed to activate some blown fuse indicators relying on fusing of restraining wires for activation.

When indicator 10 is used with switch 13, travel of plunger 14 trips switch 13, which provides a signal indicating that fuse 11 has blown. Because plunger 14 has 0.240" total travel when released and has 10 ounces of force throughout its travel, it has ample travel and force to activate microswitches requiring 0.110" to 0.120" throw and over 3.0 ounces force at these extensions for tripping, requirements that cannot be met by prior art indicators having about only 0.10" travel and 2.6 ounces force provided by springs restrained by phosphor bronze wires that release plungers by fusing. Plunger and spring combinations having greater than 0.11" travel (preferably greater than 0.15" and most preferably greater than 0.2") and force greater than 3.0 ounces (preferably greater than 3.5 ounces and most preferably greater than 5.0 ounces) can also be used.

The use of tungsten as a material for restraining wire 18 has many advantages. Tungsten has a high tensile strength of 500,000 psi (compared with 47,000 psi for phosphor bronze, 42,000 psi for silver, and 60,000 psi for copper), a high melting temperature of 3400° C. (compared with 1100° C. for phosphor bronze), and a low specific heat of 0.154 J/gm/° C. (compared with 0.377 J/gm/° C. for phosphor bronze, 0.258 J/gm/° C. for silver, and 0.430 J/gm/° C. for copper). The high strength provides impact resistance to indicator 10, preventing it from tripping, e.g., if dropped, during shipping, handling, and installation; because indicator 10 is designed to be tripped by melting of meltable region 40, wire 18 can be made thicker and stronger than alloy restraining wires that need to be thin to fuse readily at design voltages. Also, the high melting temperature permits activation at lower voltages, and the low specific heat provides reduced pressures to be dissipated during short circuit, both as already discussed.

OTHER EMBODIMENTS

Other embodiments of the invention are within the scope of the claims. For example, a plunger with a meltable region might be used with a restraining wire of another material so long as the melting temperature of the wire is sufficiently higher than the melting temperature of the meltable region and the wire has sufficient electrical resistance to generate enough heat to melt the meltable region and release the plunger when the fuse blows; while wire 18 advantageously trips when the current through it causes a voltage drop of 0.5 volt or better, in some applications, the indicator might not need to activate unless the voltage drop exceeds 2.0 volts or even 3.0 volts or higher. Also, the strength and low specific heat of tungsten make it a good material for a restraining wire in other blown fuse indicator designs, and the mounting of spring 16 and the use of a back cover over a restraining wire and press-fit terminals might be advantageously used in designs that do not employ meltable regions on plungers.

What is claimed is:

1. An externally mounted blown fuse indicator for use with a fuse comprising a housing having a bore for slidably receiving a shaft of a plunger therein, said bore having a sliding axis therein, a plunger having a shaft slidably mounted in said bore, said plunger having an extending end portion that extends from said housing when said plunger is moved relative to said bore, said plunger having a restraining wire receiving surface that is oriented transverse to the sliding axis of the bore for engagement by a restraining wire and a meltable region adjacent to said restraining wire receiving surface, a spring biasing said extending end portion of said plunger away from said housing, and a restraining wire accessible for electrical connection with a fuse, said restraining wire being mechanically anchored with respect to said housing and engaging said restraining wire surface, said restraining wire having a melting temperature sufficiently higher than the melting temperature of said meltable region and having a sufficiently high electrical resistance to generate enough heat to melt said meltable region and release said plunger when subjected to increased current when said fuse blows.

2. The indicator of claim 1 wherein said plunger is made of insulating material.

3. The indicator of claim 2 wherein said plunger is made of molded plastic material.

4. The indicator of claim 3 wherein said plastic comprises Nylon 6/6.

5. The indicator of claim 1 wherein said restraining wire is made of tungsten.

6. The indicator of claim 3 wherein said restraining wire is made of tungsten.

7. The indicator of claim 1 further comprising a pair of terminals carried by said housing for making electrical connection to a fuse.

8. The indicator of claim 1 wherein said restraining wire receiving surface is at the opposite end of said shaft from said extending end portion.

9. The indicator of claim 8 wherein said plunger has a notch, and said restraining wire receiving surface is located at said notch.

10. The indicator of claim 1 wherein said extending end portion includes a head that is larger than said shaft, and said spring engages said head.

11. The indicator of claim 1 wherein said housing has a cylindrical recess that is coaxial with and surrounds said bore, and said spring sits in said cylindrical recess.

12. The indicator of claim 1 further comprising two potting material masses on said housing on opposite sides of said bore in which said restraining wire is embedded.

13. The indicator of claim 12 wherein said housing has a front surface through which said extending end portion extends and a back surface on the opposite side of said housing, said back surface having two wells in which said potting material masses are located and grooves leading from said bore to said wells, portions of said wire being located in said grooves, said bore opening to said back surface, said restraining wire receiving surface being located near said back surface when said plunger is restrained by said wire.

14. The indicator of claim 13 further comprising a pair of terminals carried by said housing for making electrical connection to a fuse, and wherein said terminals have anchored ends anchored to said housing and connecting ends for connecting to a fuse, and said restraining wire has end portions extending beyond said wells and engaging said anchored ends of said terminals.

15. The indicator of claim 14 wherein said housing has terminal recesses, and said anchored ends of said terminals are press-fitted into said terminal recesses.

16. The indicator of claim 15 wherein said terminal recesses open to said back surface, and said wire is held by frictional engagement between said anchored ends of said terminals and housing surfaces defining said terminal recesses.

17. The indicator of claim 16 wherein said terminals are L-shaped and have two legs, said anchored ends are on one said leg, said connector ends are on the other said leg, said connector ends extend to opposite sides of said housing, said housing has channels in said back surface leading away from said wells, said other said legs are in said channels, and said connector ends extend from said channels.

18. The indicator of claim 13 further comprising a cover that is secured to and covers said back surface of said housing.

19. The indicator of claim 15 further comprising a cover that is secured to and covers said back surface of said housing.

20. The indicator of claim 17 further comprising a cover that is secured to and covers said back surface of said housing.

21. The indicator of claim I wherein said plunger extends greater than 0.11" from said housing when released from said restraining wire and has greater than 3 ounces force when extended 0.11".

22. The indicator of claim 1 wherein said bore and said shaft of said plunger are cylindrical in shape.

23. The indicator of claim 1 wherein said housing has a surface for mounting on said fuse, said housing is longer along a first axis than a perpendicular second axis, said first and second axes are in a plane that is perpendicular to said sliding axis, said housing has ends at opposite sides of said housing along said first axis and tabs at said ends for engagement with mating structure on ends of a switch, and further comprising a pair of terminals carried by said housing for making electrical connection to a fuse, said terminals extending from opposite said ends of said housing.

24. The indicator of claim 1 wherein said plunger has a transverse tab extending radially to the side of said shaft, and wherein said housing has a first axial slot extending along said bore and a stop surface at an end of said first axial slot, and wherein said tab slides within said first axial slot and is biased by said spring against said stop surface when released from said restraining wire.

25. The indicator of claim 24 wherein said tab is at an end of said shaft, and wherein said housing has a second axial slot that opens to a front surface of said housing beyond said stop surface and an open region spaced from said front surface permitting travel of said tab from said second axial slot to said first axial slot.

26. The indicator of claim 25 wherein both said axial slots open to a back surface of said housing, and said open region is at said back surface of said housing.

27. An externally mounted blown fuse indicator for use with a fuse comprising a housing having a bore for slidably receiving a shaft of a plunger therein, said bore having a sliding axis therein, a plunger having a shaft slidably mounted in said bore, said plunger having an extending end portion that extends from said housing when said plunger is moved relative to said bore, said plunger having a restraining wire receiving surface that is transverse to the sliding axis of the bore for engagement by a restraining wire, said restraining wire receiving surface being located at the opposite end of said shaft from said extending end portion, a spring biasing said extending end portion of said plunger away from said housing, said spring engaging a portion of said plunger between said restraining wire receiving surface and said extending end portion, a restraining wire accessible for electrical connection with a fuse, said restraining wire being mechanically anchored with respect to said housing and engaging said restraining wire surface, wherein said housing has a tubular guide member that has said bore therethrough and a cylindrical recess that is coaxial with and surrounds said tubular guide member, and said spring sits in said cylindrical recess.

28. The indicator of claim 27 wherein said extending end portion includes a head that is larger than said shaft and has a back surface, and said spring engages said back surface of said head.

29. The indicator of claim 27 wherein said plunger has a notch, and said restraining wire receiving surface is located at said notch.

30. The indicator of claim 27 wherein said housing has a front surface through which said extending end portion extends and a back surface on the opposite side of said housing, said bore opening to said back surface, said back surface having two wells on opposite sides of said bore and grooves leading from said bore to said wells, and further comprising two potting material masses that are located in said wells and embed said restraining wire, portions of said wire being located in said grooves, said restraining wire receiving surface being located near said back surface when said plunger is restrained by said wire.

31. The indicator of claim 30 further comprising a pair of terminals carried by said housing for making electrical connection to a fuse, and wherein said housing has terminal recesses, wherein said terminals have anchored ends that are press-fitted into said terminal recesses and connecting ends for connecting to a fuse, and said restraining wire has end portions extending beyond said wells and engaging said anchored ends of said terminals.

32. The indicator of claim 31 wherein said terminal recesses open to said back surface, said terminals are L-shaped and have two legs, said anchored ends are on one said leg, said connector ends are on the other said leg, said connector ends extend to opposite sides of said housing, said housing has channels in said back surface leading away from said wells, said other legs are in said channels, and said connector ends extend from said channels.

33. The indicator of claim 27 wherein said housing has an front surface through which said extending end portion extends and a back surface on the opposite side of said housing, said bore opening to said back surface, and further comprising a cover that is secured to and covers said back surface of said housing.

34. The indicator of claim 30 further comprising a cover that is secured to and covers said back surface of said housing.

35. The indicator of claim 32 further comprising a cover that is secured to and covers said back surface of said housing.

36. The indicator of claim 27 wherein said plunger extends greater than 0.11" from sail housing when released from said restraining wire and has greater than 3 ounces force when extended 0.11".

37. The indicator of claim 27 wherein said bore and said shaft of said plunger are cylindrical in shape.

38. An externally mounted blown fuse indicator comprising a housing made of insulating material and having a bore for slidably receiving a shaft of a plunger therein, said bore having a sliding axis therein, said housing having a surface for mounting on a fuse, said housing being longer along a first axis than a perpendicular second axis, said first and second axes being in a plane that is perpendicular to said sliding axis, said housing having ends at opposite sides of said housing along said first axis and tabs at said ends for engagement with mating structure on ends of a switch, a plunger having a shaft slidably mounted in said bore, said plunger having an extending end portion that extends from said housing when said plunger is moved relative to said bore, said plunger having a restraining wire receiving surface transverse to the sliding axis of the bore for engagement by a restraining wire, a spring biasing said extending end portion of said plunger away from said housing, a restraining wire accessible for electrical connection with a fuse, said restraining wire being mechanically anchored with respect to said housing and engaging said restraining wire surface, and a pair of terminals carried by said housing for making electrical connection to said fuse, said terminals extending from opposite said ends of said housing.

39. The indicator of claim 38 wherein said housing has a front surface through which said extending end portion extends and a back surface on the opposite side of said housing, said restraining wire is mechanically anchored at said back surface of said housing, and said bore opens to said back surface, and further comprising a cover that is secured to and covers said back surf said housing.

40. The indicator of claim 38 wherein said plunger extends greater than 0.11" from said housing when released from said restraining wire and has greater than 3 ounces force when extended 0.11".

41. The indicator of claim 38 wherein there are two said tabs at each said end of said housing.

42. An externally mounted blown fuse indicator comprising a housing having a front surface, a back surface, and a bore for slidably receiving a shaft of a plunger therein, said bore having a sliding axis therein, said bore opening at said front and back surfaces, a plunger having a shaft that is slidably mounted in said bore, said plunger having an extending end portion that extends from said front surface of said housing when said plunger is moved relative to said bore, said plunger having a restraining wire receiving surface that is oriented transverse to the sliding axis of the bore for engagement by a restraining wire, a spring biasing said extending end portion of said plunger away from said housing, a restraining wire that is mechanically anchored with respect to said housing at said back surface of said housing and engages said restraining wire surface, a cover that is attached to said back surface and covers said restraining wire, said cover being thinner than the distance from said front surface to said back surface, and a pair of terminals that are carried by said housing for making electrical connection to said fuse, each said terminal being electrically connected to a respective end of said restraining wire and being electrically isolated from the other said terminal except for the connection through said restraining wire.

43. The indicator of claim 42 further comprising two potting material masses in which said restraining wire is embedded on said back surface on opposite sides of said bore.

44. The indicator of claim 43 wherein said back surface has wells in which said potting material masses are located and grooves leading from said bore to said wells, portions of said wire being located in said grooves, said restraining wire surface being located near said back surface when said plunger is restrained by said wire.

45. The indicator of claim 44 further comprising a pair of terminals carried by said housing for making electrical connection to a fuse, and wherein said terminals have anchored ends anchored to said housing and connecting ends for connecting to a fuse, and said restraining wire has end portions extending beyond said wells and engaging said anchored ends of said terminals.

46. The indicator of claim 45 wherein said housing has terminal recesses, and said anchored ends of said terminals are press-fitted into said terminal recesses.

47. The indicator of claim 46 wherein said terminal recesses open to said back surface, and said wire is held by frictional engagement between said anchored ends of said terminals and housing surfaces defining said terminal recesses.

48. The indicator of claim 47 wherein said terminals are L-shaped and have two legs, said anchored ends are on one said leg, said connector ends are on the other said leg, said connector ends extend to opposite sides of said housing, said housing has channels in said back surface leading away from said wells, said other legs are in said channels, and said connector ends extend from said channels.

49. The indicator of claim 42 wherein said housing is made of a single molded plastic part.

50. The indicator of claim 13, 30, 34, or 43 wherein said plunger has a transverse tab extending radially to the side of said shaft at an end of said shaft, wherein said housing has a first axial slot extending along said bore and a stop surface at an end of said first axial slot, wherein said tab slides within said first axial slot and is biased by said spring against said stop surface when released from said restraining wire, and wherein said housing has a second axial slot that opens to said front surface of said housing beyond said stop surface and an open region spaced from said front surface permitting travel of said tab from said second axial slot to said first axial slot.

51. An externally mounted blown fuse indicator comprising a housing having a bore for slidably receiving a shaft of a plunger therein, said bore having a sliding axis therein, a plunger having a shaft that is slidably mounted in said bore, said plunger having an extending end portion that extends from said housing when said plunger is moved relative to said bore, said plunger having a restraining wire receiving surface that is oriented transverse to the sliding axis of the bore for engagement by a restraining wire, a spring biasing said extending end portion of said plunger away from said housing, and a restraining wire accessible for electrical connection with said fuse, said restraining wire being mechanically anchored with respect to said housing and engaging said restraining wire surface, said plunger extending greater than 0.11" from said housing when released from said restraining wire and having greater than 3 ounces force when extended 0.11".

52. The indicator of claim 51 wherein said plunger has greater than 3.5 ounces force when extended 0.11".

53. The indicator of claim 51 wherein said plunger extends said housing greater than 0.2".

54. The indicator of claim 53 wherein said plunger has greater than 5.0 ounces force when extended 0.2".

55. The indicator of claim 54 wherein said plunger has 10.0 ounces force or greater when extended 0.2".

56. An externally mounted blown fuse indicator for mounting on a fuse comprising a housing having a bore for slidably receiving a shaft of a plunger therein, said bore having a sliding axis therein, a plunger having a shaft that is slidably mounted in said bore, said plunger having an extending end portion that extends from said housing when said plunger is moved relative to said bore, said plunger having a restraining wire receiving surface that is oriented transverse to the sliding axis of the bore for engagement by a restraining wire, a spring biasing said extending end portion of said plunger away from said housing, and a restraining wire accessible for electrical connection with said fuse, said restraining wire being mechanically anchored with respect to said housing and engaging said restraining wire surface, said restraining wire being made of tungsten, wherein said plunger extends greater than 0.11" from said housing when released from said restraining wire and has greater than 3 ounces force when extended 0.11".

57. The indicator of claim 56 wherein said plunger extends from said housing greater than 0.2" and has greater than 5.0 ounces force when extended 0.2".

58. The indicator of claim 56 further comprising two potting material masses on said housing on opposite sides of said bore in which said restraining wire is embedded.

59. The indicator of claim 58 wherein said housing has a front surface through which said extending end portion extends and a back surface on the opposite side of said housing, said back surface having two wells in which said potting material masses are located and grooves leading from said bore to said wells, portions of said wire being located in said grooves, said bore opening to said back surface, said restraining wire receiving surface being located near said back surface when said plunger is restrained by said wire.

60. The indicator of claim 59 further comprising a cover that is secured to and covers said back surface of said housing.

61. The indicator of claim 9, 18, 27, 38, 42, or 56 wherein said plunger has a transverse tab extending radially to the side of said shaft, and wherein said housing has a first axial slot extending along said bore and a stop surface at an end of said first axial slot, and wherein said tab slides within said slot and is biased by said spring against said stop surface when released from said restraining wire.

* * * * *